US008640572B2

(12) United States Patent
Chen

(10) Patent No.: US 8,640,572 B2
(45) Date of Patent: Feb. 4, 2014

(54) WRENCH

(76) Inventor: Jun Fan Chen, Taichung (TW)

( * ) Notice: Subject to any disclaimer, the term of this patent is extended or adjusted under 35 U.S.C. 154(b) by 295 days.

(21) Appl. No.: 13/204,699

(22) Filed: Aug. 7, 2011

(65) Prior Publication Data

US 2013/0032007 A1 Feb. 7, 2013

(51) Int. Cl.
*B25B 17/00* (2006.01)

(52) U.S. Cl.
USPC ..... 81/57.32; 81/57.3

(58) Field of Classification Search
USPC ..... 81/57.32, 57.3, 57.22, 57.26, 57.27
See application file for complete search history.

(56) References Cited

U.S. PATENT DOCUMENTS 3,987,691 A * 10/1976 Savage ..... 81/57.3
5,458,603 A * 10/1995 Futch, Sr. ..... 606/104
5,461,949 A * 10/1995 Carver ..... 81/57.3
6,131,494 A * 10/2000 Quenneville ..... 81/125.1
6,923,094 B1 * 8/2005 Marquardt ..... 81/57.3
7,093,520 B2 * 8/2006 Tuanmu ..... 81/63.1
7,703,356 B2 * 4/2010 Bass ..... 81/57.3

FOREIGN PATENT DOCUMENTS

CH 598026 A5 * 4/1978 ..... B60B 29/00

* cited by examiner

*Primary Examiner* — Hadi Shakeri
(74) *Attorney, Agent, or Firm* — Shia Banger

(57) ABSTRACT

A wrench includes a transmitting device and a shell. The transmitting device comprises a rotor, a first working member, a second working member, a first linking member and a second linking member. The first linking member is disposed between the first working member and the rotor. The shell has a containing room for the linking device to be disposed therein. The shell comprises a middle section. The first end of the middle section extends upwardly to connect with the first section. The second end of the middle section extends downwardly to connect with the second section. Thus, the wrench has two stair portions of different horizontal level. And Users can hold the wrench more stably. Because the wrench uses the rotor and two linking members to drive the first working member and the second working member rotating, a total size of the wrench can be kept as smaller as possible.

19 Claims, 9 Drawing Sheets

WRENCH

BACKGROUND OF THE INVENTION

1. Field of the Invention

The present invention relates to a wrench, and more particularly to a wrench which can be adapted to be used in narrow working spaces, and a wrench which can be driven by a tool for operating.

2. Description of the Prior Art

Conventional wrenches are disclosed in patents such as U.S. Pat. Nos. 5,540,122, 4,867,016, 4,491,042 and US20040093990. The wrenches in the patent mentioned above use various driving structures to enable those wrenches of being driven by a tool to operate in narrow working spaces. In other words, those wrenches use a single driving structure to have an end of one working member drive an end of another working member.

The wrenches described above are straight and flat-shaped. However, speaking of operating in narrow working spaces, it's not easy for users to hold the straight and flat-shaped wrench. Thus, users would hold the wrench unstably with shaking, and it's also difficult to focus power on one of the working members in order to drive another working member rotating. As a result, users need more time and attention to finish a work. Moreover, it is also possible that the wrench would fall into the narrow working space during an operation period because of holding unstably.

Therefore, a wrench with a special design could improve the problems mentioned above. For instance, a wrench with stair-shaped design could be an option. If the wrench is made with stair-shape design, and those two working members still have to be driven by the driving structure to keep effects of linking rotation. An outer shell of the wrench with stair-shaped design needs to be enlarged so as to contain those two working members and the driving structure. On the other hand, once the outer shell is enlarged, the wrench would not be able to enter the narrow working space, and advantages before reforming are nonsense as well. The application of the stair-shaped wrenches would be limited.

Furthermore, because the wrenches mentioned above have only a single driving structure, those wrenches can only be equipped with two working members at two ends of wrenches along a longitude direction of those wrenches. When working in some narrow working spaces, penetrating holes of both two ends of the shell, protruded by a working member, are obstructed due to an operation angle, so users can not drive any working member through any penetrating hole on both two ends of the shell. That means applications of the wrenches are limited by working environments.

With concerns about problems described above, it is necessary to design a wrench which can be held stably with minimized size, and be adapted to be used in various narrow spaces of working environments.

SUMMARY OF THE INVENTION

The main object of the present invention is to provide a wrench which can be held stably with minimized size, and can be adapted to be used in various narrow spaces of working environments.

To achieve the above, a wrench of the present invention includes a transmitting device and a shell. The transmitting device includes a rotor, a first working member, a second working member, a first linking member and a second linking member. The rotor includes an upside driving portion and an underside driving portion. The first working member has at least one head, and the second working member also has at least one head. The first linking member is disposed between the first working member and the upside driving portion, and the second working member is disposed between the second working member and the underside driving portion. The shell has a containing room, used for the transmitting device to be positioned therein. The shell has a first section, a second section, and a middle section, and the middle section has a first end and a second end. The first end extends upwardly to connect with the first section, and the second end extends downwardly to connect with the second section. Thus, one stair portion of different horizontal level is formed between the first section and the middle section, another stair portion of different horizontal level is formed between the second section and the middle section. The first section has a penetrating hole, and the first working member is disposed in the first section. The head of the first working member protrudes from the penetrating hole of the first section. The second section also has a penetrating hole, and the second working member is disposed in the second section. The head of the second working member protrudes from the penetrating hole of the second section as well.

The wrench of the present invention is stair-shaped so that users can have some spaces for hands to hold the wrench stably when working. As such, users can focus power on the wrench easier without slipping. And the wrench can be adapted to be used in various narrow spaces. Moreover, the wrench uses the rotor and two linking members to drive the first working member and the second working member rotating. Therefore, the total size of the wrench can be kept as smaller as possible. And the transmitting device can still keep the best effects of linking and rotating. The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
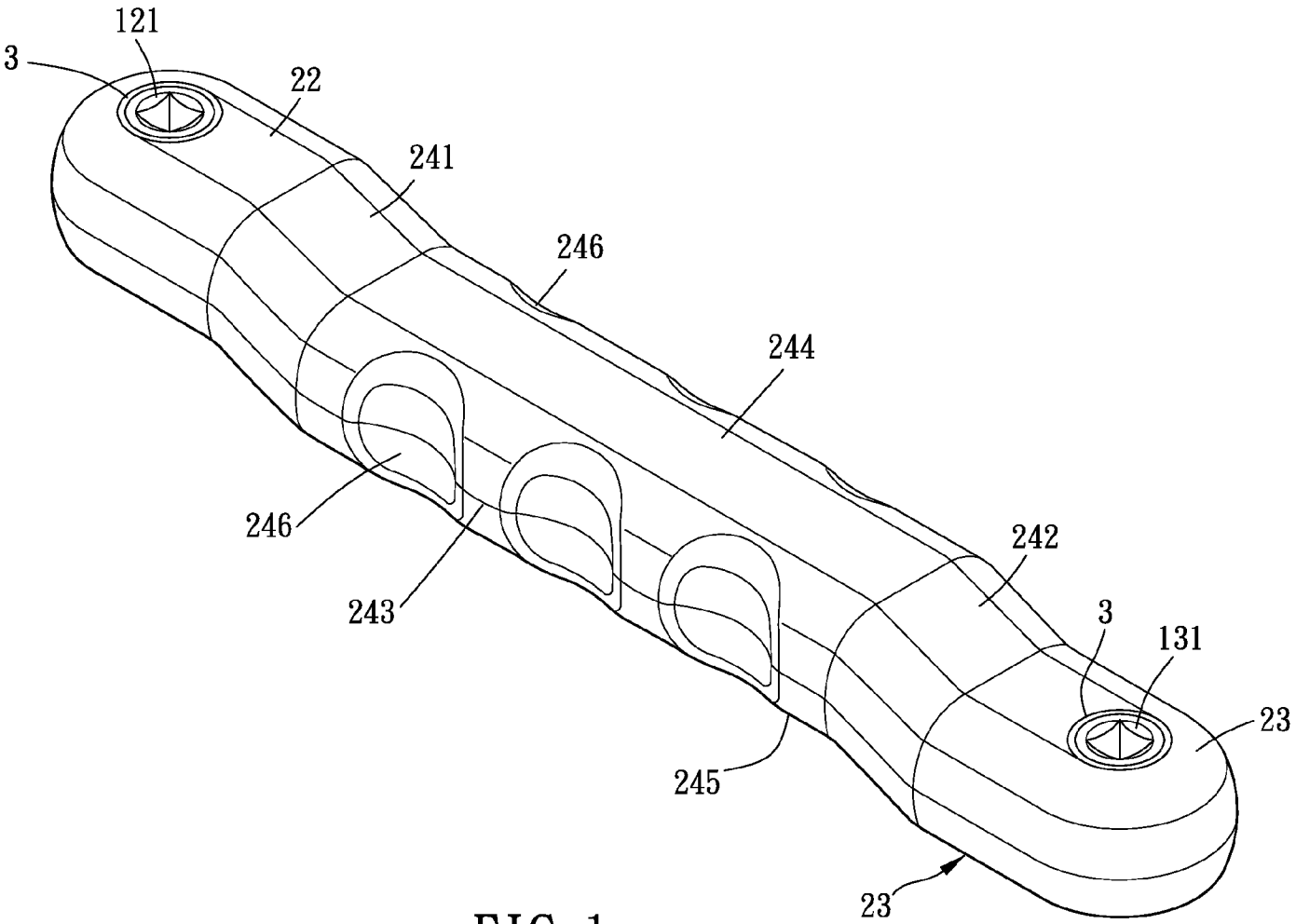
FIG. 1 is a stereogram showing a first embodiment of the present invention.
Figure 2:
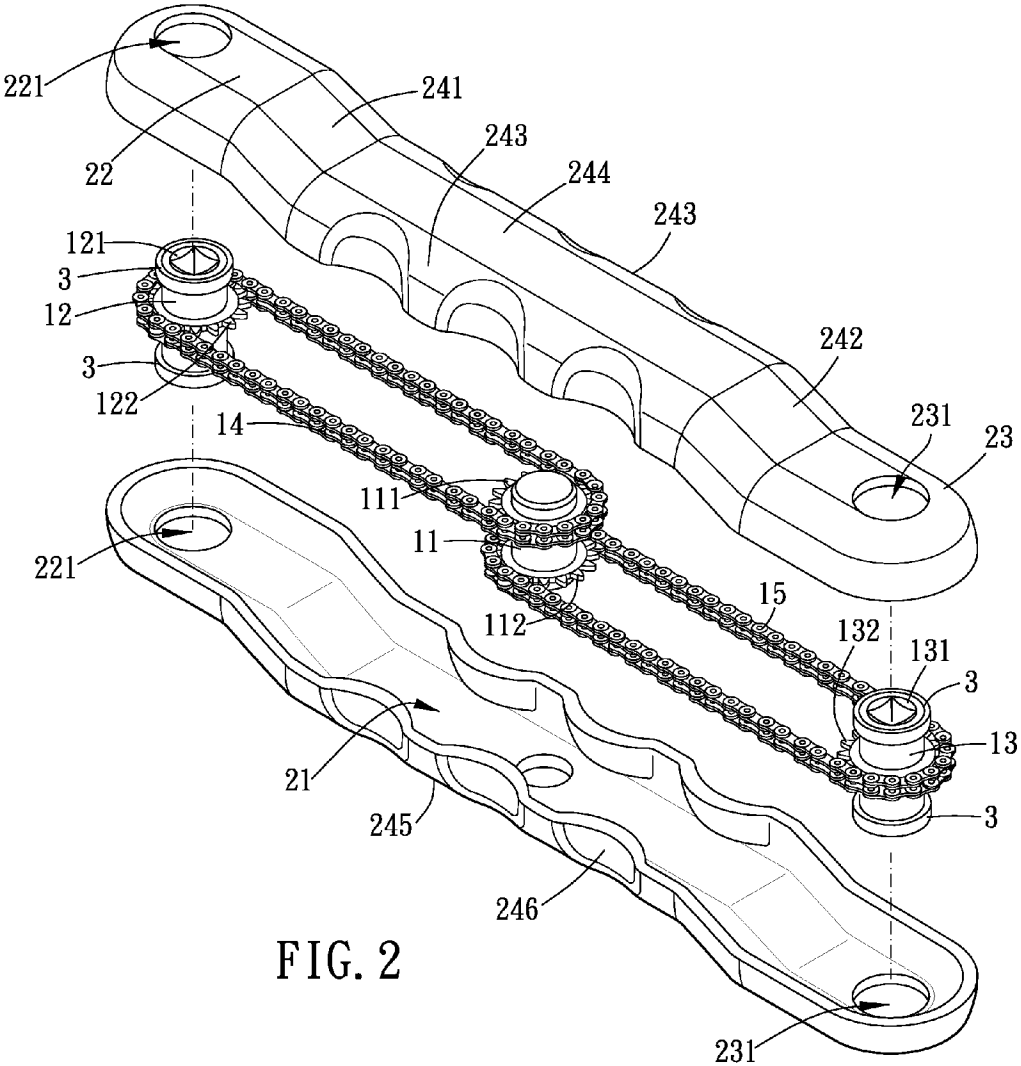
FIG. 2 is a decomposition drawing of a first embodiment of the present invention.
Figure 3:
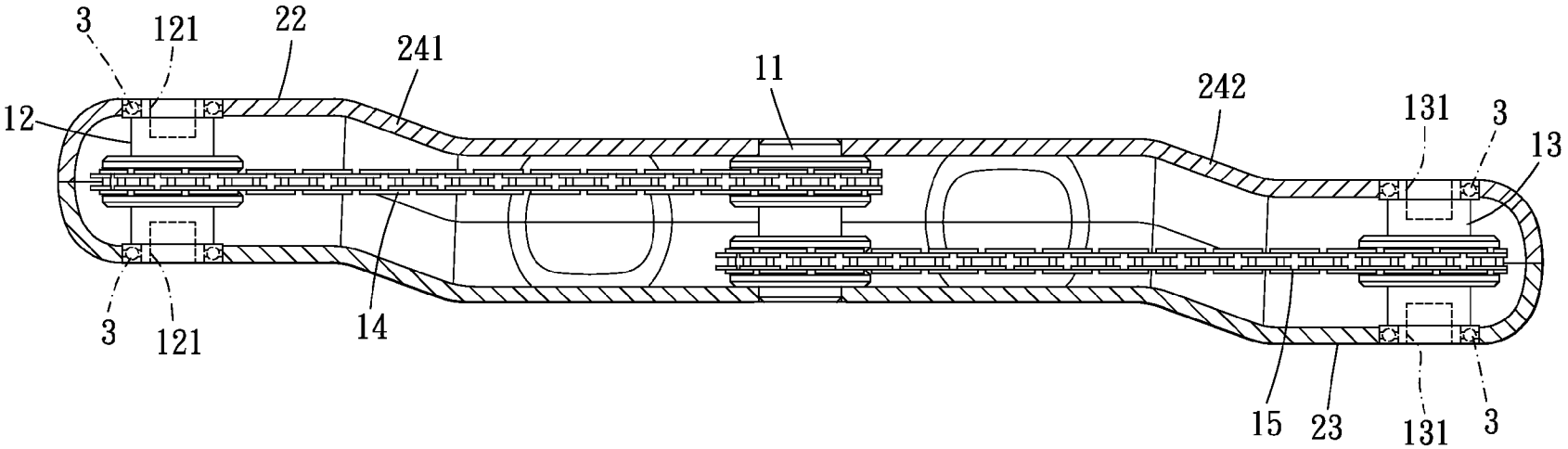
FIG. 3 is a perspective drawing from a side view of a first embodiment of the present invention.
Figure 4:
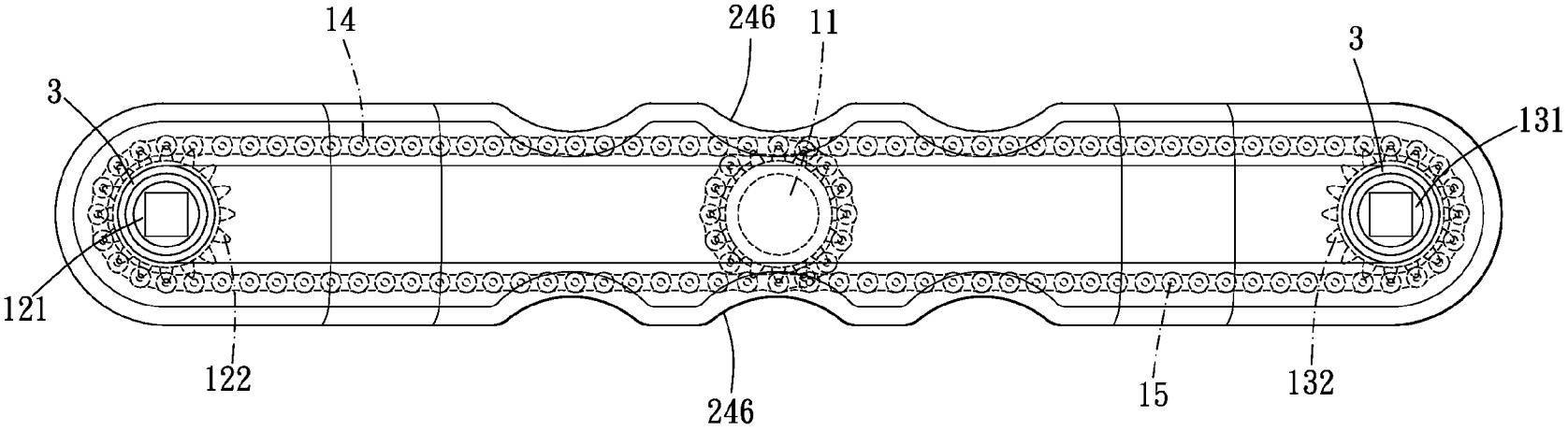
FIG. 4 is a perspective drawing from an up-side view showing a first embodiment of the present invention.

Please refer to FIG. 1 to FIG. 3 for the first embodiment of the present invention. A wrench of the present embodiment includes a transmitting device and a shell.

Figure 5:
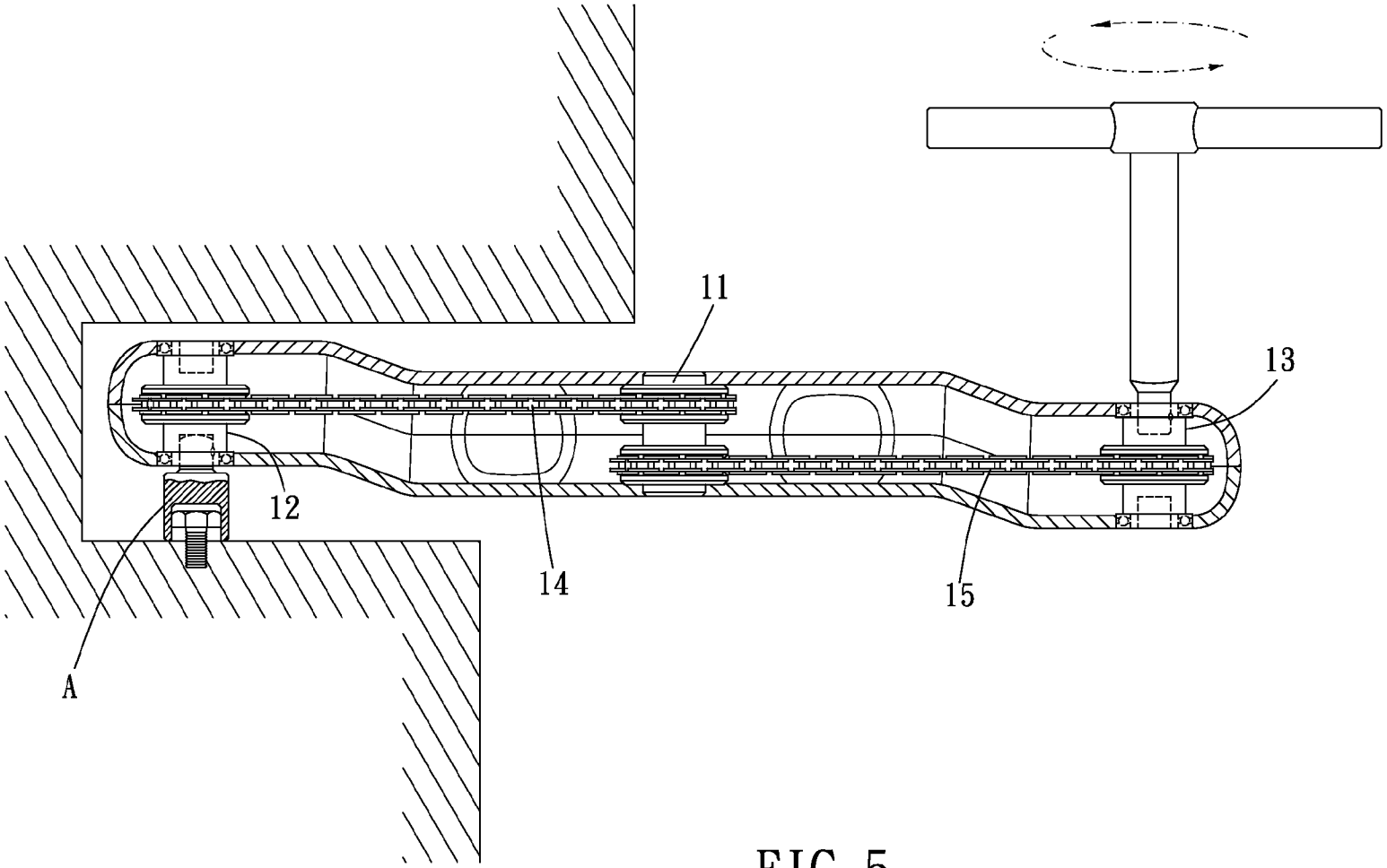
FIG. 5 is an operating condition drawing of the first embodiment of the present invention.
Figure 6:
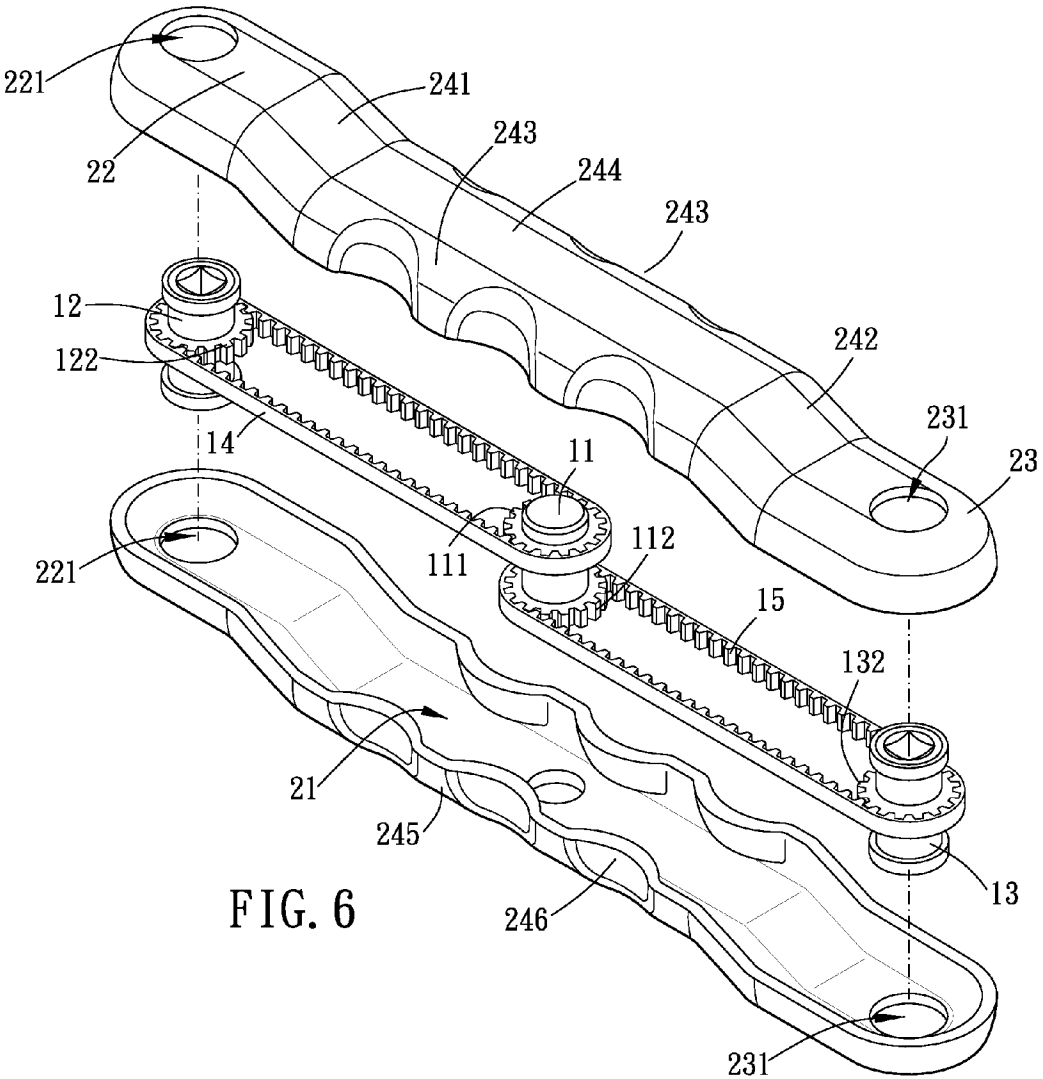
FIG. 6 is a decomposition drawing of a second embodiment of the present invention.
Figure 7:
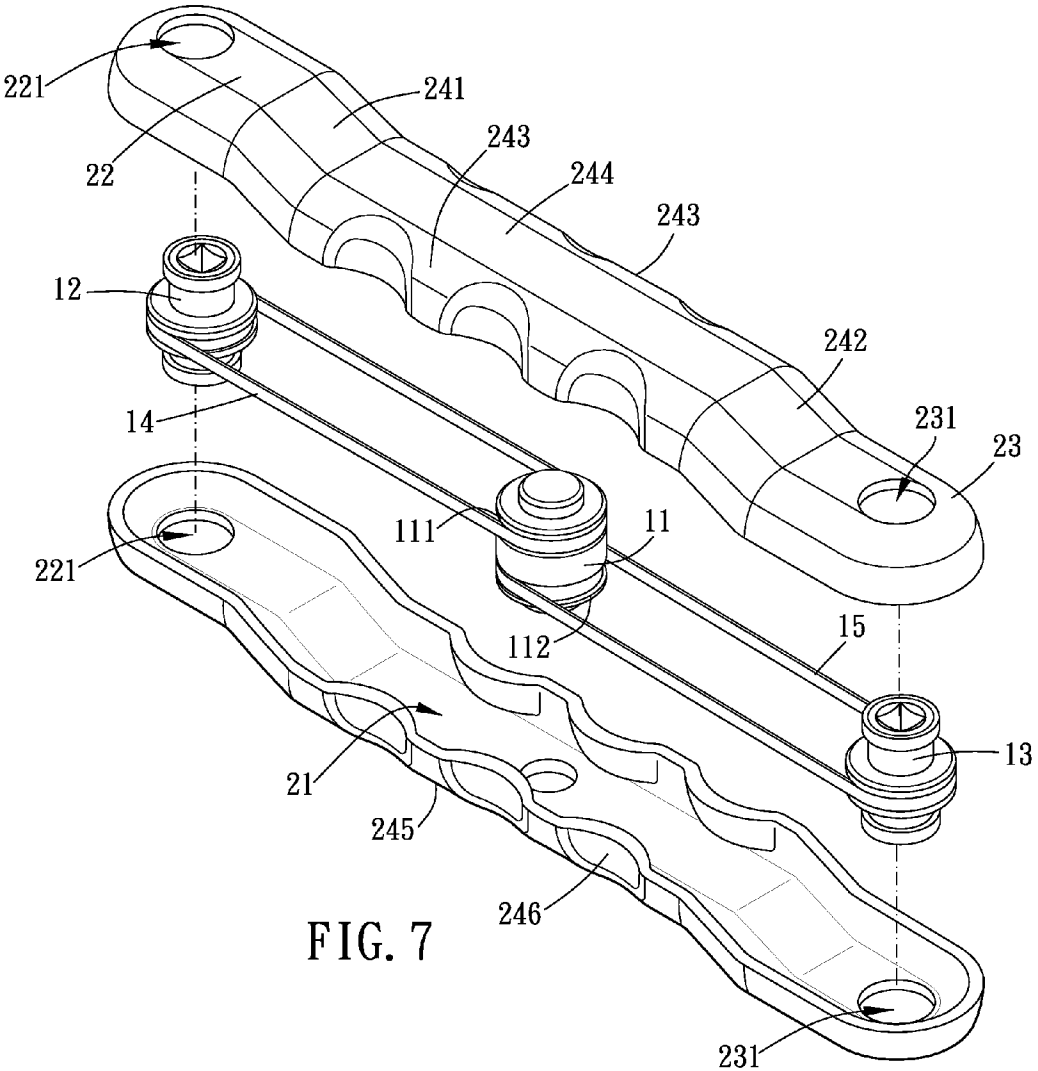
FIG. 7 is a decomposition drawing of a third embodiment of the present invention.

The transmitting device comprises a rotor 11, a first working member 12, a second working member 13, a first linking member 14 and a second linking member 15. The rotor 11 comprises an upside driving portion 111 and an underside driving portion 112. The first working member 12 has at least one head 121, and the second working member 13 has at least one head 131. The heads 121, 131 mentioned above can be adapted to be inserted by a cylinder A or a tool, as shown in FIG. 5. The first linking member 14 is disposed between the first working member 12 and the upside driving portion 111, and the second linking member 15 is disposed between the second working member 13 and the underside driving portion 112. To increase an efficient structure to the present invention, the first working member 12 comprises a toothed plate 122, and the second working member 13 can comprise a toothed plate 132. The upside driving portion 111 can comprise a toothed plate, and the underside driving portion 112 can comprise a toothed plate. The first linking member 14 is disposed between the toothed plate 122 of the first working member and the toothed plate 111 of the upside driving portion. The second linking member 15 is disposed between the toothed plate 132 of the second working member and the toothed plate 112 of the underside driving portion. Each of the first linking member 14 and the second linking member 15 is a chain. As such, the first linking member 14 can be rotational engaged between the toothed plate 122 of the first working member and the toothed plate 111 of the upside driving portion. The second linking member 15 can be rotational engaged between the toothed plate 132 of the second working member and the toothed plate 112 of the underside driving portion. In the second embodiment of the present invention, as shown in FIG. 6, each of the first linking member 14 and the second linking member 15 can also be a toothed chain. Of course, structures of the first linking member and the second linking member of the present invention are not limited by the structure described above. Taking the third embodiment for instance, as shown in FIG. 7, the chains or the toothed chains described above are replaced by two belts, serving as the first linking member 14 and the second linking member 15. And the same rotating function of linking can also be achieved without the toothed plate serving as the first working member 12, the working member 13, the upside driving portion 111 and the underside driving portion 112.

Please refer to FIG. 1 to FIG. 5, the shell has a containing room 21, and the transmitting device is disposed in the containing room 21. The shell comprises a first section 22, a second section 23, and a middle section 24. The middle section has a first end 241 and a second end 242, two sides 243, a top surface 244 and a bottom surface 245. The first end 241 extends upwardly to connect with the first section 22, the second end 242 extends downwardly to connect with the second section 23. Thus, one stair portion of different horizontal level is formed between the first section and the middle section, another stair portion of different horizontal level is formed between the second section and the middle section. The first section 22 has a penetrating hole 221, and the first working member 12 is disposed in the first section 22. The head 121 of the first working member protrudes from the penetrating hole 221 of the first section. Also, the second section 23 has a penetrating hole 231, and the second working member 13 is disposed in the second section 23. The head 131 of the second working member protrudes from the penetrating hole 231 of the second section.

Please refer back to FIG. 5 again, when users use the wrench to disassemble a screw, the second working member 13 can be rotated by a tool. Meanwhile, the second linking member 15, the rotor 11, the first linking member 14 and the first working member 12 would be driven to rotate by the second working member 13. The cylinder A is disposed on the first working member 12 so that the cylinder A could engage with the screw. The cylinder A would be driven to rotate with disassembling the screw from a constructing surface when the first working member 12 rotates.

Because the wrench of the present invention is stair-shaped, the wrench would not completely fit with the constructing surface. Some spaces would be left for users' hand to hold the wrench stably. As such, users can focus power on the wrench easier without slipping. The two sides 243 of the middle section have plural grooves 246 respectively. The plural grooves 246 can be used for users' hand to hold stably. The plural grooves 246 of each side is interval arranged with each other. Positions of the plural grooves 246 on one side 243 are symmetrical to positions of the plural grooves 246 on another side 243. As such, users can hold the wrench stably and conveniently.

Furthermore, because the rotor 11, the first linking member 14 and the second linking member 15 are disposed in the transmitting device, the wrench could use the first working member and the second member with normal sizes. And the total size of the wrench is still kept minimized after wrench composition. And the transmitting device can still keep best effects of linking and rotating.

Also, in order to enable the wrench to be adapted to more different narrow spaces, the first section 22 has two penetrating holes 221, and the second section has two penetrating holes 231. To be more precisely, the two penetrating holes 221 of the first section are respectively located on the top surface and the bottom surface of the first section. The two penetrating holes 231 of the second section are respectively located on the top surface and the bottom surface of the second section. As shown in FIG. 3, the first working member includes two heads 121, and the two heads 121 are respectively located in one of the two penetrating holes 221. The first working member includes two heads 131, and the two heads 131 are respectively located in one of the two penetrating holes 231. As such, users can choose two penetrating holes suitable to be adapted to the narrow spaces. Thus, the wrench of the present invention has more practicability.

Figure 8:
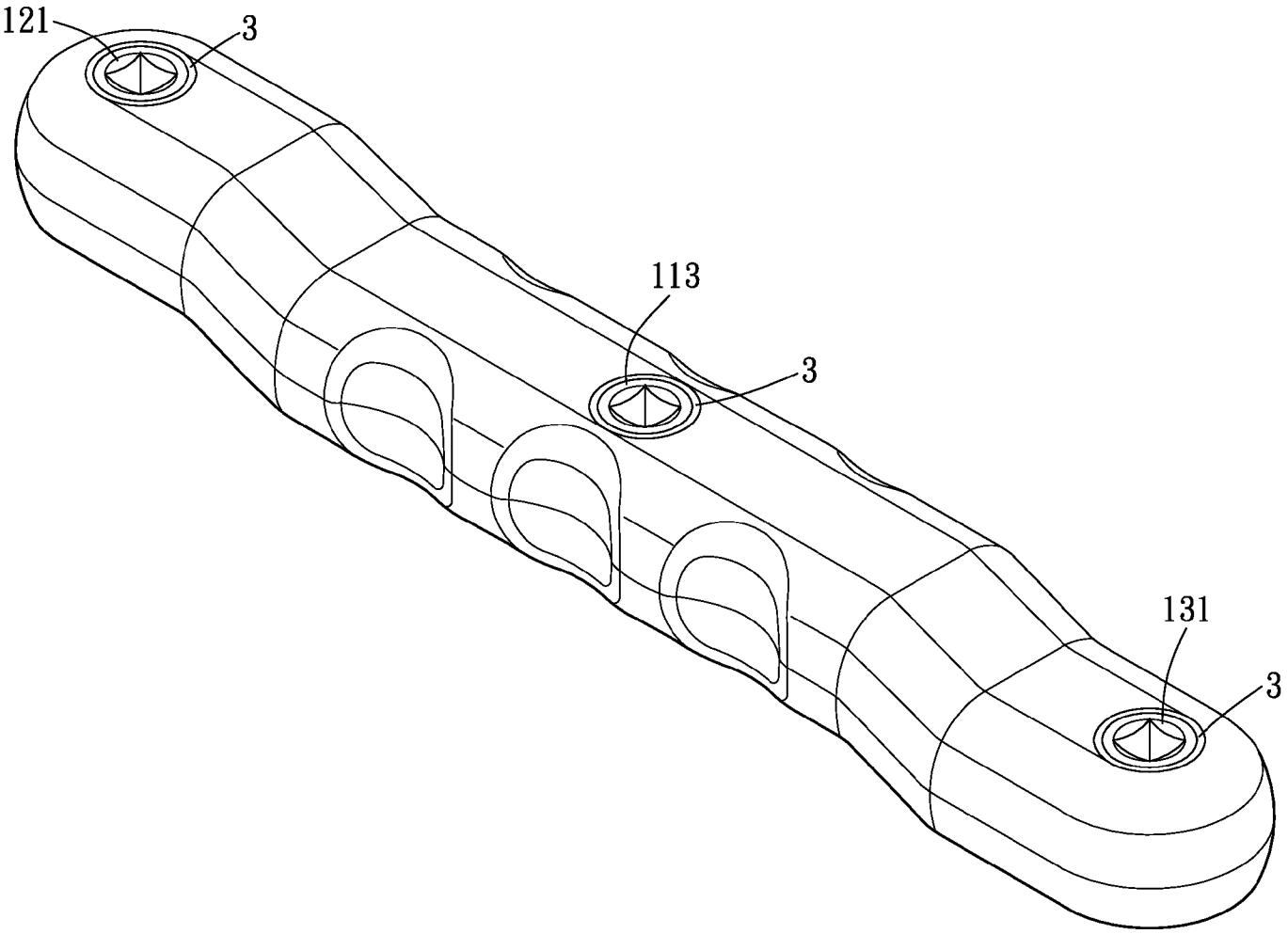
FIG. 8 is a decomposition drawing of a fourth embodiment of the present invention.
Figure 9:
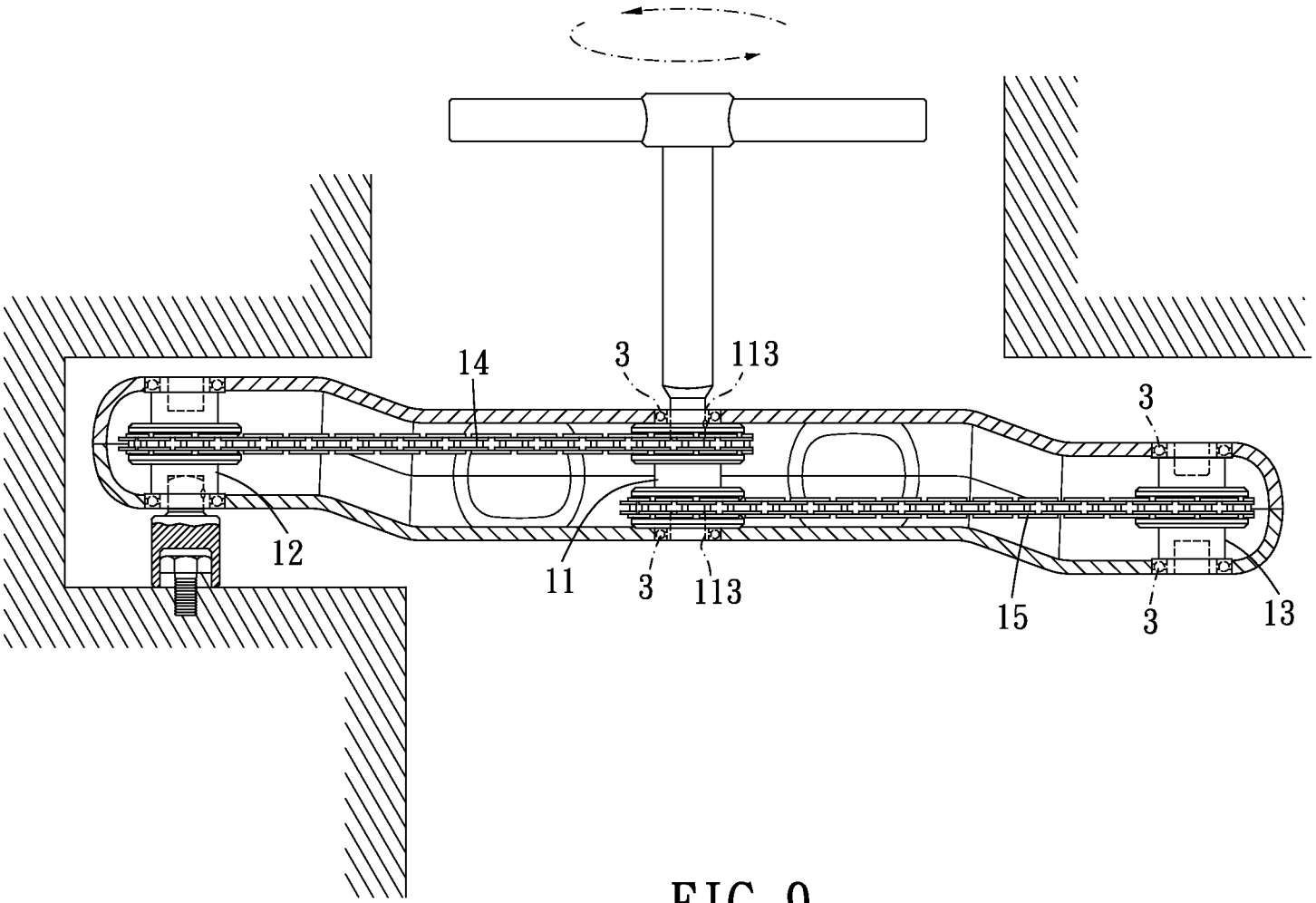
FIG. 9 is an operating condition drawing of the fourth embodiment of the present invention.

However, some narrow constructing spaces have limitations on angle. Therefore, in the forth embodiment of the present invention, as shown in FIG. 8 and FIG. 9, a structure of the forth embodiment is different form the first embodiment. The difference is that the top surface 244 of the middle section has one through hole, and the bottom surface of the middle surface has another through hole. The rotor includes two heads 113, and the linking member is disposed in the middle section. The two heads 113 of the rotor are respectively located in one of the two through holes. In other words, the rotor can keep not only a characteristic of a middle linking component that drives the first working member and the second member to rotate, but also effects of the working members. When the first working member and the second working member can not be used for disassembling a screw by a tool because of the angle limitations, the tool can be inserted in the head of the rotor to disassemble the screw. Therefore, problems caused by the angle limitations can be improved.

What is worthy mentioning is that the heads of the first working member, the second working member, or the rotor can respectively rotate more smoothly with a bearing 3. The bearing 3 can be respectively disposed around the heads of the first working member, the second working member, or the rotor. The bearings can prevent the working members from wear and tear. As such, the disassembling efficiency and the lifetime of the present invention are further enhanced.

What is claimed is:

1. A wrench, comprising:

a transmitting device, comprising a rotor, a first working member, a second working member, a first linking member and a second linking member, the rotor comprising an upside driving portion and an underside driving portion, the first working member having at least one head, the second working member having at least one head, the first linking member being disposed between the first working member and the upside driving portion, the second linking member being disposed between the second working member and the underside driving portion; and a shell, the shell having a containing room, the transmitting device being disposed in the containing room; wherein the shell comprises a first section, a second section, and a middle section, the middle section has a first end and a second end, the first end extends upwardly to connect with the first section, the second end extends downwardly to connect with the second section, one stair portion of different horizontal section is formed between the first section and the middle section, another stair portion of different horizontal section is formed between the second section and the middle section; wherein the first section has a penetrating hole, the first working member is disposed in the first section, the head of the first working member protrudes from the penetrating hole, the second section has a penetrating hole, the second working member is disposed in the second section, the head of the second working member protrudes from the penetrating hole;

wherein the middle section comprises a top surface and a bottom surface, the top surface has one through hole, the bottom surface has another through hole, the rotor comprises two heads, the linking member is disposed in the middle section, the two heads of the rotor are respectively disposed in the through holes.

2. The wrench of claim 1, wherein the middle section includes two sides, each side has plural grooves.

3. The wrench of claim 2, wherein the plural grooves of each side is interval arranged with each other, positions of the plural grooves on one side are symmetrical to positions of the plural grooves on another side.

4. The wrench of claim 3, wherein the first section has two penetrating holes, the two penetrating holes are respectively located on a top surface and a bottom surface of the first section, the second section has two penetrating holes, the two penetrating holes are respectively located on a top surface and a bottom surface of the second section; wherein the first working member comprises two heads, the two heads of the first working member are respectively disposed in the penetrating holes of the first section, the second working member comprises two heads, the two heads of the second working member are respectively disposed in the penetrating holes of the second section.

5. The wrench of claim 4, wherein the wrench further comprises plural bearings, the bearings are disposed around the heads.

6. The wrench of claim 3, wherein the first working member comprises a toothed plate, the second working member comprises a toothed plate, the upside driving portion comprises a toothed plate, the underside driving portion comprises a toothed plate, the first linking member is disposed between the toothed plate of the first working member and the toothed plate of the upside driving portion, the second linking member is disposed between the toothed plate of the second working member and the toothed plate of the underside driving portion.

7. The wrench of claim 2, wherein the first section has two penetrating holes, the two penetrating holes are respectively located on a top surface and a bottom surface of the first section, the second section has two penetrating holes, the two penetrating holes are respectively located on a top surface and a bottom surface of the second section; wherein the first working member comprises two heads, the two heads of the first working member are respectively disposed in the penetrating holes of the first section, the second working member comprises two heads, the two heads of the second working member are respectively disposed in the penetrating holes of the second section.

8. The wrench of claim 7, wherein the wrench further comprises plural bearings, the bearings are disposed around the heads.

9. The wrench of claim 2, wherein the first working member comprises a toothed plate, the second working member comprises a toothed plate, the upside driving portion comprises a toothed plate, the underside driving portion comprises a toothed plate, the first linking member is disposed between the toothed plate of the first working member and the toothed plate of the upside driving portion, the second linking member is disposed between the toothed plate of the second working member and the toothed plate of the underside driving portion.

10. The wrench of claim 9, wherein each of the first linking member and the second linking member are chains respectively.

11. The wrench of claim 9, wherein each of the first linking member and the second linking member are toothed chains respectively.

12. The wrench of claim 2, wherein the first linking member and the second linking member are belts respectively.

13. The wrench of claim 1, wherein the first section has two penetrating holes, the two penetrating holes are respectively located on a top surface and a bottom surface of the first section, the second section has two penetrating holes, the two penetrating holes are respectively located on a top surface and a bottom surface of the second section; wherein the first working member comprises two heads, the two heads of the first working member are respectively disposed in the penetrating holes of the first section, the second working member comprises two heads, the two heads of the second working member are respectively disposed in the penetrating holes of the second section.

14. The wrench of claim 13, wherein the wrench further comprises plural bearings, the bearings are disposed around the heads.

15. The wrench of claim 1, wherein the first working member comprises a toothed plate, the second working member comprises a toothed plate, the upside driving portion comprises a toothed plate, the underside driving portion comprises a toothed plate, the first linking member is disposed between the toothed plate of the first working member and the toothed plate of the upside driving portion, the second linking member is disposed between the toothed plate of the second working member and the toothed plate of the underside driving portion.

16. The wrench of claim 15, wherein each of the first linking member and the second linking member are chains respectively.

17. The wrench of claim 15, wherein each of the first linking member and the second linking member are toothed chains respectively.

18. The wrench of claim 1, wherein the first working member comprises a toothed plate, the second working member comprises a toothed plate, the upside driving portion comprises a toothed plate, the underside driving portion comprises a toothed plate, the first linking member is disposed between the toothed plate of the first working member and the toothed plate of the upside driving portion, the second linking member is disposed between the toothed plate of the second working member and the toothed plate of the underside driving portion.

19. The wrench of claim 1, wherein the first linking member and the second linking member are belts respectively.

* * * * *